United States Patent [19]

Vinson

[11] 4,324,185

[45] Apr. 13, 1982

[54] PERMANENT-MAGNET-LEVITATED TRANSPORTATION SYSTEM

[76] Inventor: Roy D. Vinson, 146 Cottage Dr., Covina, Calif. 91722

[21] Appl. No.: 170,615

[22] Filed: Jul. 21, 1980

[51] Int. Cl.[3] ..... B61B 13/08

[52] U.S. Cl. ..... 104/283; 335/302

[58] Field of Search ..... 104/283, 121, 286, 281; 335/304, 302, 306; 180/98

[56] References Cited

U.S. PATENT DOCUMENTS

| | | | |
|---|---|---|---|
| 3,783,794 | 1/1974 | Gopfert et al. | 104/286 |
| 3,895,585 | 7/1975 | Schwarzler | 104/281 |
| 3,899,979 | 8/1975 | Godsey, Jr. | 104/283 |
| 3,951,074 | 4/1976 | Cooper | 104/283 |

*Primary Examiner*—Richard A. Bertsch

*Attorney, Agent, or Firm*—Allard A. Braddock

[57] ABSTRACT

A vertically stable permanent magnet levitation system for use in transportation comprises a pair of spaced parallel ferromagnetic rail members, a cobalt-rare earth permanent levitation magnet with transverse polarity orientation positioned between the rails with an air gap between both poles and the rails, a cargo-carrying vehicle supported by the magnet, and means for maintaining the levitation magnet in centered position with respect to the rails.

7 Claims, 4 Drawing Figures

PERMANENT-MAGNET-LEVITATED TRANSPORTATION SYSTEM

BACKGROUND OF THE INVENTION

Transportation systems which use magnetic fields to provide levitation of a cargo-carrying or passenger-carrying vehicle have been under study and experiment for many years. The IEEE Transactions on Magnetics for September, 1974, pages 397–473, reported on a number of such systems which had been investigated and many of which were under test.

In general, magnetic levitation, sometimes called "maglev", has been of two types. Attractive maglev has used ordinary electromagnets which are attracted to the underside of a ferromagnetic rail without making contact. The magnet current is controlled by solid state amplifiers so as to maintain a clearance gap between the magnet poles and steel rail. Propulsion of levitated vehicles is by linear induction motor or linear synchronous motor.

Repulsion maglev has also been tested. In this form of vehicle levitation, superconducting coils on board the vehicle provide the magnetic field. Lift is produced by repulsion between these superconducting magnets and eddy currents that their moving magnetic fields induce in an aluminum rail structure. The vehicle must be moving at a speed of about twenty miles per hour before the induced eddy currents provide sufficient lift to levitate the vehicle. Obviously, this take-off speed is an objectionable feature of repulsion maglev as is the necessity of packing equipment on board the vehicle to maintain the superconducting condition of the magnet coils.

The use of electromagnets to provide the principal lifting force for a vehicle is at best cumbersome and costly. In my patent application, Ser. No. 151,412, filed May 19, 1980, on which a notice of allowance is pending, I described and claimed a permanent magnet system in which a vehicle is levitated by attraction between a set of permanent magnets in the vehicle and a steel rail above the magnets. Stability is provided by repulsion between a second set of permanent magnets in the vehicle and a rail directly above composed of ceramic magnets with transverse polarity orientation. In such a system strong vertical forces must be quickly applied for both levitation and repulsion in order to counteract both downward drop-out and upward track contact tendencies under changing load and side wind conditions.

The present invention is aimed at a permanent-magnet-levitation system in which vertical movement of a vehicle is inherently stable and horizontal movement is controlled to prevent contact beteen levitation magnets and the track.

SUMMARY OF THE INVENTION

In the levitation system of the present invention a pair of spaced parallel ferromagnetic rail members serve as a track. A plurality of spaced cobalt-rare earth permanent levitation magnets with alternate transverse north-south polarity orientation are positioned in the space between the rails with an air gap between both poles and the rails. The magnets support a cargo-carrying vehicle and are maintained in position between the rails by mechanical or other means which respond to any off-center movement of the magnets to restore then to a centered position with respect to the rail members.

DESCRIPTION OF PREFERRED EMBODIMENTS

Figure 1:
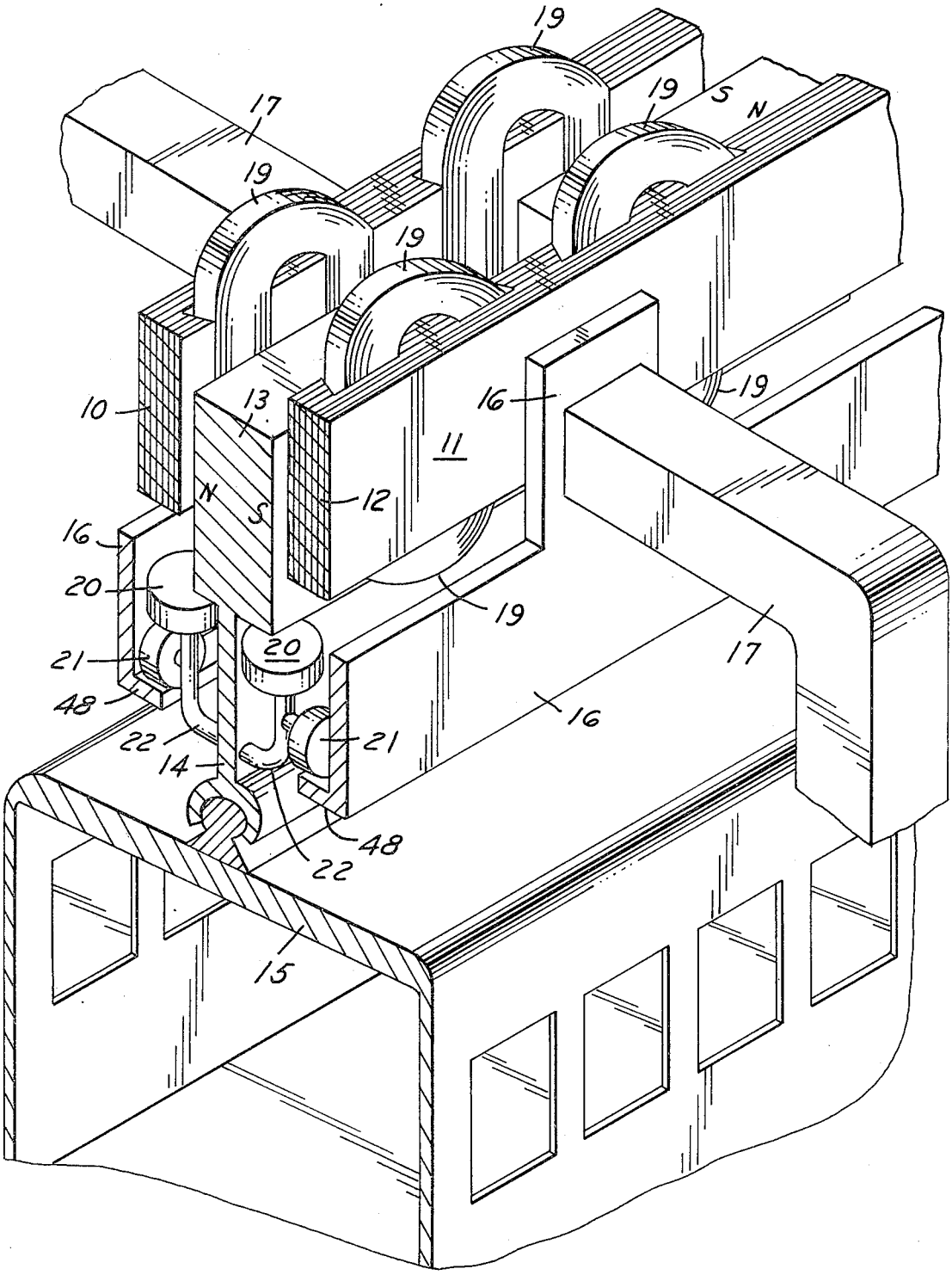
FIG. 1 is a cut-away schematic perspective view of a section of track and a vehicle suspened therefrom.
Figure 2:
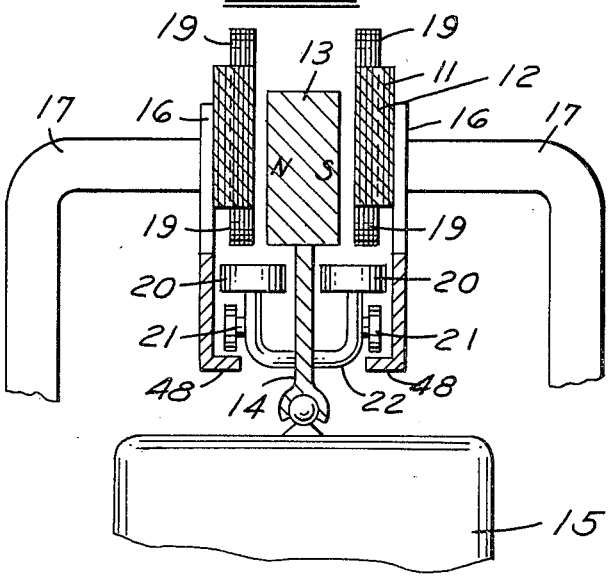
FIG. 2 is a frontal sectional view of the perspective of FIG. 1.

The track of this invention consists of a pair of horizontally spaced rail members 10 and 11 composed of ferromagnetic material laminated to reduce eddy currents as illustrated at the numeral 12. Each of the rail members 10 and 11 is attached to a continuous support member 16 which may also be composed of ferromagnetic material but does not need to be so. The support members 16 are in turn fastened to spaced support pillars 17. The base of each of the support members 16 terminates in a continuous strip member 48 to give an L-shaped cross-sectional configuration to the members 16 and 48 as shown in FIGS. 1 and 2.

Centered between the rails 10 and 11 are a plurality of spaced cobalt-rare earth magnets 13 which have alternate transverse polarity orientation as indicated by the letters "S" and "N". There is a small air gap between each pole and the nearest vertical surface of the rails 10 and 11. Thus, as indicated by the arrowed line in FIG. 3, magnetic flux from the north pole of the magnet 13 illustrated at the left in FIG. 3 crosses the air gap to the rail 10, proceeds along the rail 10 to the south pole of the magnet 13 at the right, thence to the rail 11 and along the rail 11 to the south pole of the magnet 13 at the left, and back to the north pole of this magnet to complete a magnetic circuit.

Cobalt-rare earth magents have become well known and commercially available during the past fifteen years. Their magnetic field strength is so great that a kilogram of such magnets can hold fifty kilograms of ferromagnetic material against the pull of gravity. The technology of such magnets will not be discussed herein as it plays no part in the present invention. Of course, other permanent magnets possessing magnetic field strength comparable to that of cobalt-rare earth magnets could be used in place of the cobalt-rare earth magnets.

As an example of the effectiveness of cobalt-rare earth magnets, a 20,000-pound vehicle with 100 passengers requires about 500 pounds of high-magnetic-strength (25 million gauss-oersteds) rare earth magnets. This provides for a safety factor of 2 and allows $1\frac{1}{2}$ centimeter gaps on either side of the magnets—an important feature. With this large a gap, variations in roadbed have negligible effect on operations. The influence of roadbed variations is of course minimal anyway because they only affect the area of the gap and not the length of the gap.

Figure 4:
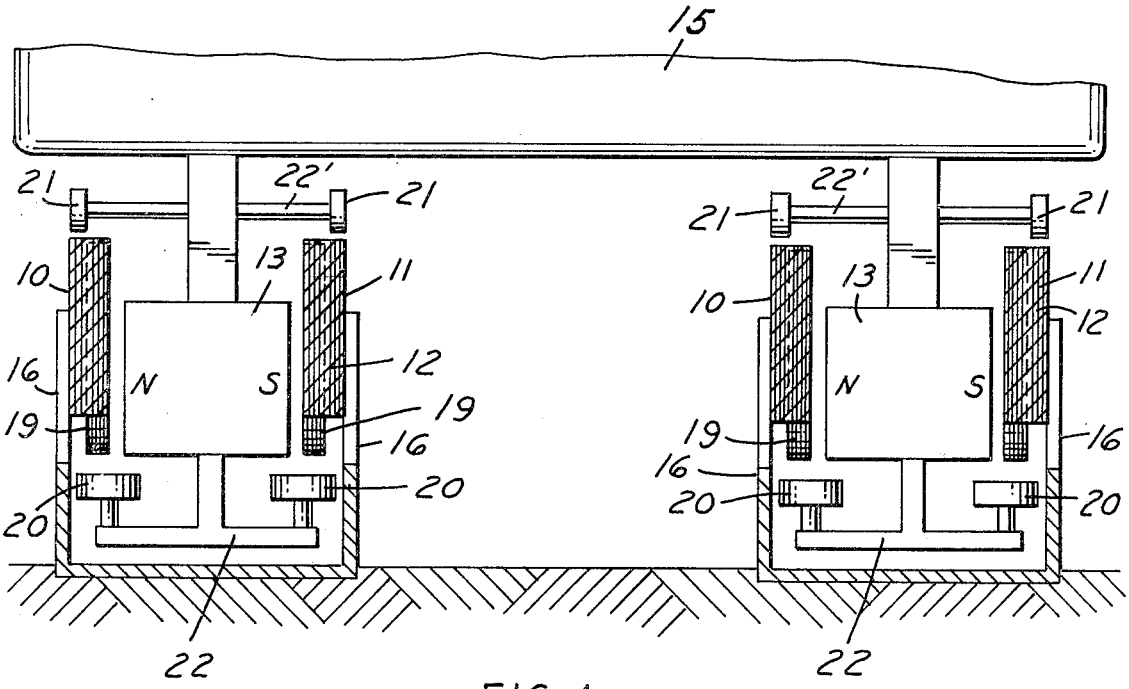
FIG. 4 is a schematic section showing a pair of tracks and a vehicle in above-rail position.

A hanger member 14 connects a cargo-carrying vehicle 15 to the magnets 13. The weight of the vehicle 15 exerts a downward force on the magnets 13 producing a vertically off-center position of the magnets as illustrated in FIGS. 1, 2 and 4. If there were no such downward force, the magnets 13 would seek a vertically centered position with respect to the closest faces of the rails 10 and 11. The magnets 13 resist either an upward or a downward force from this centered position. Thus, the system of this invention is inherently stable with respect to vertical forces. Of course, an applied force can be sufficiently great to cause fall-out. For this reason, the system must be designed so that the maximum likely applied force will be insufficient to cause fall-out. In addition, a mechanical limiting arrangement with a set of wheels 21 is incorporated as a safety measure to limit vertical movement downward.

The vertical stability afforded by the present system overcomes problems of roll and pitch present in other systems and enables safe high-speed operation of the vehicle 15. This may be perceived by reference to the embodiment of FIG. 4. Superficially, it appears that this embodiment is the magnetic equivalent of a conventional wheeled system but it operates in a significantly safer manner. If a very severe side wind strikes the side of a wheeled vehicle the windward wheels can be raised from rail contact and the weight of the vehicle thrown on the leeward wheels. If the wind force persists the vehicle can be pushed beyond a critical angle and gravity will then aid the wind force to pull the vehicle over on its side.

In the embodiment of FIG. 4 the same application of wind force will raise the magnets on the windward side of the vehicle and lower those on the leeward. But as the windward magnets rise above their vertically centered position with respect to the rails 10 and 11, they will exert a downward force on the windward side of the vehicle which—combined with the increased upward force applied by the magnets on the leeward side of the vehicle—will offer to the wind force a resistance tending to restore the vehicle 15 to normal operating position.

By providing inherent vertical stability rather than inherent horizontal stability as in other maglev systems the present invention converts a difficult problem—vertical stability-into a rather simple one. Horizontal destabilizing forces are much smaller than vertical ones and a plurality of wheels 20 mounted on a shaft 22, which are not under load (except in embodiments where they are used for propulsion) can readily contain them.

In the embodiment illustrated in FIG. 1 a plurality of spaced coils 19 are run through the rails 10 and 11. These coils are used for synchronous propulsion of the vehicle 15 after the manner of Sawyer U.S. Pat. No. 4,061,089.

While the system has inherent vertical stability, it does not have inherent horizontal stability and for this reason the wheels 20 serve to maintain the magnets 13 in a horizontally centered position with respect to the rails 10 and 11.

Figure 3:
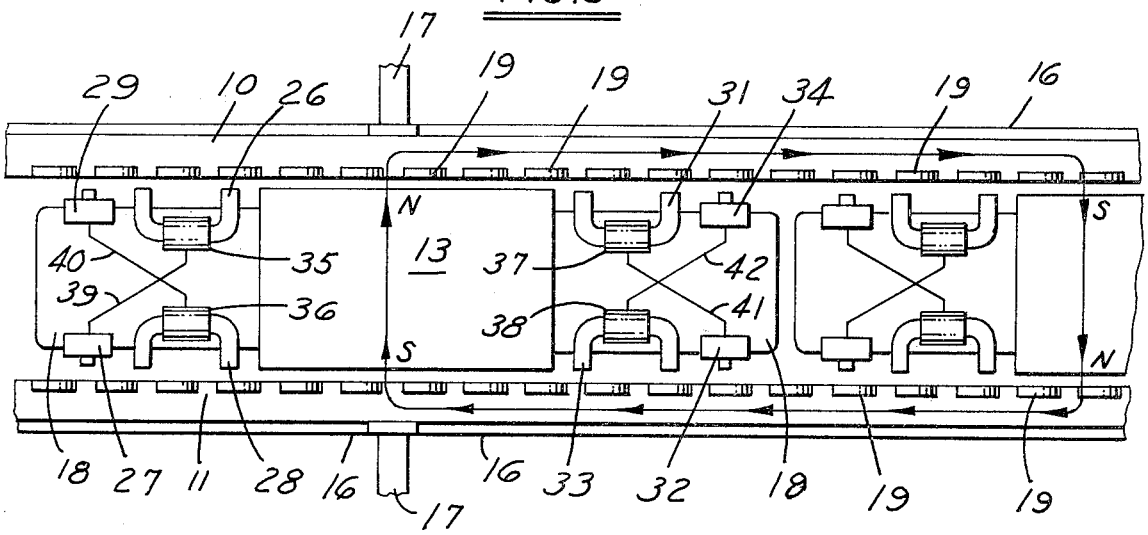
FIG. 3 is a cut-away schematic plan view of a section of track showing electromagnets for maintaining horizontal stability of levitation magnets.

The structure of FIG. 3 illustrates an electromagnetic means for centering the magnets 13 with respect to the rails 10 and 11. It may be used alone or—preferably—to supplement the action of the wheels 20. In this embodiment, centering of each magnet 13 between the rails 10 and 11 is maintained or aided by electromagnets. A set of extensions 18 is fixedly connected one at each end to the magnets 13. Each extension 18 has a set of electromagnets such as 26, 28 and 31, 33 positioned in spaced relation with the vertical inner walls of the rails 10 and 11. Associated with the electromagnet 26 is a gap sensor 27 positioned in spaced relation with the inner vertical surface of the rail 11. A typical gap sensor is a Hall effect device that senses a change in air gap dimension by producing a voltage error signal which can be used to energize an electromagnet. When the gap sensor 27 senses that it is getting too close to the inner vertical surface of the rail 11, it sends an energizing signal along an electrical connector 39 to a coil 35 which activates the electromagnet 26 to pull the magnet 13 back toward centered position between the rails 10 and 11. The electromagnets 28, 31 and 33 with their respective gap sensors 29, 32 and 34, their respective electric cables 40, 41 and 42, and their respective coils 36, 37 and 38 operate in a complementary fashion. Thus, the fast-acting electromagnetic controls of FIG. 3 operate to prevent any contact between the magnets 13 and the rails 10 and 11.

FIG. 4 illustrates the invention as applied to a rail-below-vehicle system. While the illustration of this embodiment shows a double track system it could also be used as a single track system provided the vehicle 15 included a gyroscope to maintain it in upright position. The levitation mechanism of FIG. 4 operates in the same manner as the levitation mechanisms of FIGS. 1 and 2. In this embodiment the coils 19 are recessed so as not to protrude above the rails 10 and 11 and the safety wheels 21 are mounted on a shaft 22' above the rails 10 and 11 so as to make contact with the tops of these rails in the event of an emergency magnetic fall-out.

In FIGS. 1–4 dimensions have been exaggerated in order to promote clarity of illustration. Each vehicle has at least two sets of magnets like the magnets 13 of FIG. 1 and they may be swivel-mounted in order to accommodate to track curvature. Typical propulsion means used in maglev systems are linear induction motors and linear synchronous motors such as are described in the aforementioned Sawyer U.S. Pat. No. 4,061,089 which issued Dec. 6, 1977. Such propulsion systems, however, are not necessary to the practice of the present invention. Utilizing conventional electric motors to rotate the wheels 20 is quite satisfactory. Thus, it can be seen that this invention is subject to many variations which can properly be considered as falling within its scope. Accordingly, the scope of the invention should not be limited other than as may be necessitated by the scope of the appended claims.

I claim:

1. A permanent magnet levitation system for use in transportation comprising:

a pair of horizontally spaced rail members composed of ferromagnetic material;

at least two permanent levitation magnets positioned between said rail members in transverse alternating polarity alignment with air gaps between said magnets and both rail members, said levitation magnets and said rail members providing generally horizontal magnetic flux paths through said air gaps;

at least one cargo compartment supported by said magnets; and means for maintaining said permanent magnets horizontally central between said rail members.

2. A levitation system as claimed in claim 1 in which there are at least two sets of spaced magnets positioned between the rail members.

3. A levitation system as claimed in claim 1 in which there are two sets of spaced parallel rail members.

4. A levitation system as claimed in claim 1 in which the centering means is a pair of wheels rigidly connected to each levitation magnet, one of each pair of wheels being rigidly positioned with respect to a vertical surface of one of the rail members and the other wheel being rigidly positioned with respect to a vertical surface of the other rail member.

5. A levitation system as claimed in claim 1 in which the centering means comprises a pair of electromagnets at each end of the levitation magnet, each pair having one electromagnet positioned in attractive relationship with the inside vertical surface of one of the rail members and the other being positioned in attractive relationship with the inside vertical surface of the other of the rail members, and a sensor for monitoring the gap between each magnet and its associated vertical rail surface, each sensor energizing the electromagnet of the opposite rail member whenever the gap it is monitoring becomes smaller than required for a centered operating position.

6. A levitation system as claimed in claim 1 in which the levitation magnet is a cobalt-rare earth magnet.

7. A permanent magnet levitation system for use in transportation comprising:

a pair of horizontally spaced rail members composed of ferromagnetic material;

at least two spaced permanent magnets positioned between said rail members, said magnets having transverse polarity alignment with the polarity of one of said magnets being oppositely disposed with respect to the polarity of the other and air gaps between the poles of said magnets and said rail members, said rail members and said magnets defining a generally horizontally disposed magnetic flux path;

and a cargo-carrying vehicle connected to said magnets.

* * * * *